US005877457A

United States Patent [19]

Corniani et al.

[11] Patent Number: 5,877,457

[45] Date of Patent: Mar. 2, 1999

[54] UNIT FOR FILLING CONTAINERS WITH POWDER

[75] Inventors: Carlo Corniani, Marmirolo; Gianpiero Zanini, Montanara, both of Italy

[73] Assignee: Azionaria Costruzioni Macchine Automatiche A.C.M.A. S.p.A., Bologna, Italy

[21] Appl. No.: 802,669

[22] Filed: Feb. 19, 1997

[30] Foreign Application Priority Data

Feb. 19, 1996 [IT] Italy ..... BO96A0071

[51] Int. Cl.[6] ..... G01G 13/02; B65B 1/30

[52] U.S. Cl. ..... 177/116; 177/120; 177/DIG. 11; 141/83

[58] Field of Search ..... 141/83; 177/115, 177/116, 120, 94, 83, 54, 58, 184, 187, 189, 210 FP, DIG. 11

[56] References Cited

U.S. PATENT DOCUMENTS

| | | | |
|---|---|---|---|
| 3,805,905 | 4/1974 | McClusky | 177/160 |
| 4,050,530 | 9/1977 | Storace | 177/1 |
| 4,703,151 | 10/1987 | Sakamoto | 177/210 FP |
| 4,782,865 | 11/1988 | Everman | 177/145 |
| 5,259,425 | 11/1993 | Johnson et al. | 141/83 |
| 5,362,929 | 11/1994 | Goto | 177/210 FP |
| 5,700,982 | 12/1997 | Neuman | 177/229 |
| 5,740,843 | 4/1998 | Burkart | 141/83 |

*Primary Examiner*—Randy W. Gibson
*Attorney, Agent, or Firm*—Pillsbury Madison & Sutro

[57] ABSTRACT

Unit for filling containers with powders, said unit comprising a measuring device envisaged for introducing a predetermined quantity of powder into a container located on a support equipment sustained by a weighing unit provided for controlling the measuring device during the filling phase of the container itself; said support equipment being provided with a shaking device which moves the container on a substantially orbital plane, in alternate directions or according to substantially orbital oscillations, in such a way as to tamp the powder inside the container itself during its filling.

4 Claims, 2 Drawing Sheets

UNIT FOR FILLING CONTAINERS WITH POWDER

BACKGROUND OF THE INVENTION

The present invention relates to a unit for filling containers with powder.

Equipments for filling containers with liquids or powders are known, which are provided with a carousel supporting a plurality of filling units, each of which comprises a measuring device meant to introduce, by gravity, a predetermined quantity of material into a corresponding container located on a corresponding support equipment.

In the case of liquids, each measuring device is controlled by a corresponding weighing unit mounted onto the carousel and meant to continuously weigh the container. During the filling phase, precisely at the moment in which the weighing unit signals the reaching of a predetermined weight corresponding to the container full-load condition, the measuring device stops the dispensing of liquids, thus closing, for example, an on-off valve of a material feed duct of the measuring device.

The filling procedure of a known type described above exhibits, however, if powders are used, a drawback due above all to a non-correct heaping of material inside the container.

In fact, as the powder is introduced by gravity into the container, it accumulates taking up a cone shape. It is evident that as the filling phase progresses, and especially in its final stage, part of the powder tends to spill out of the container thus scattering in the environment and preventing the complete and correct filling of the container. In order to avoid such drawback, the known technique teaches the use of a filling unit, which is provided with suitable means capable of making the container vibrate on the corresponding support equipment.

An embodiment of the prior art vibrating means provides for the vibrating means to be composed of a cam gear which acts under the support equipment in such a way as to make the container move in alternate directions along a vertical axis.

It is plain that alternating motion does not provide for the use of the weighing system previously described, with reference to liquids, which permits the continous checking of the container weight during its filling.

In the case of powders, the containers are filled by measuring, appropriately, the quantity of material being dispensed by the measuring devices (volumetric measuring) and the weight of the containers is checked at the end of the filling phase downstream from the filling station. As a consequence of that, the measuring of the quantity of material introduced into each container is highly imprecise and the filling of the container is, therefore, never correct.

SUMMARY OF THE INVENTION

The object of the present invention is to supply a unit for filling containers with powder which one to eliminate, in an easy and economical way, the above-mentioned drawbacks.

The stated object is realized in a unit according to the present invention for filling containers with powder, which comprises a measuring device meant to introduce the powder into a corresponding container located on a corresponding support equipment, this unit being characterised in that it comprises a weighing unit operating both along a weighing axis of the support equipment and a control axis of the measuring device during a phase of filling the container. The unit is preferably characterised in that it comprises shaking means shaped and placed in such a way as to move the container with respect to the weighing axis and in particular along a trajectory lying on a plane which is substantially perpendicular to the weighing axis.

BRIEF DESCRIPTION OF THE DRAWINGS

Further characteristics and advantages of the present invention will better emerge from the detailed description that follows, made with reference to the accompanying drawings, which represent two preferred embodiments in the form of non-limiting examples, in which.

DESCRIPTION of the PREFERRED EMBODIMENTS

With reference to the figures, the numeral 1 denotes, as a whole, a unit for filling containers 2, each of which being provided with respective an upper inlet 2*a,* with measured quantities of powder.

Figure 1:
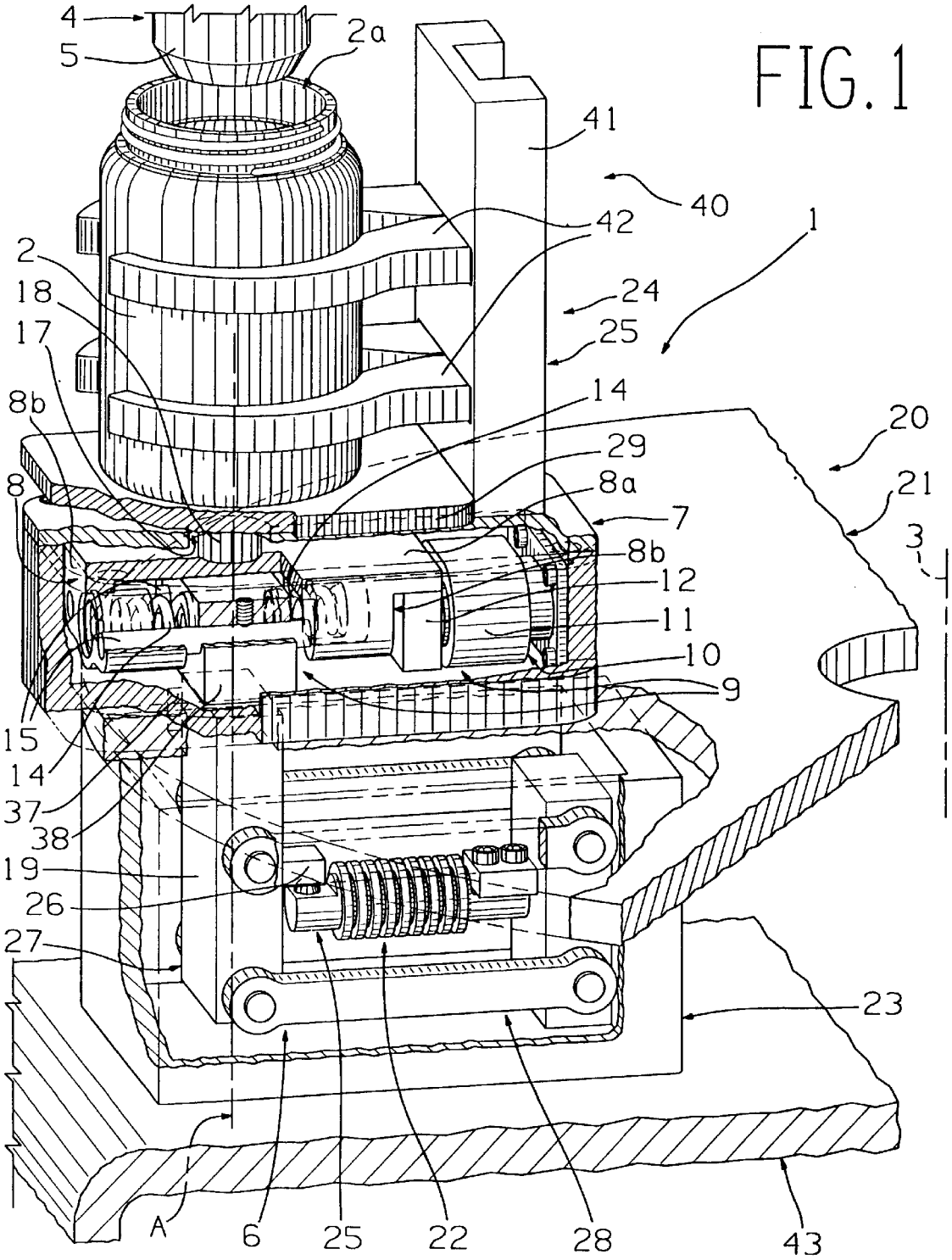
FIG. 1 shows a perspective view of a first preferred embodiment of the filling unit according to the present invention, with some parts sectioned and removed so as to better evidence others.
Figure 2:
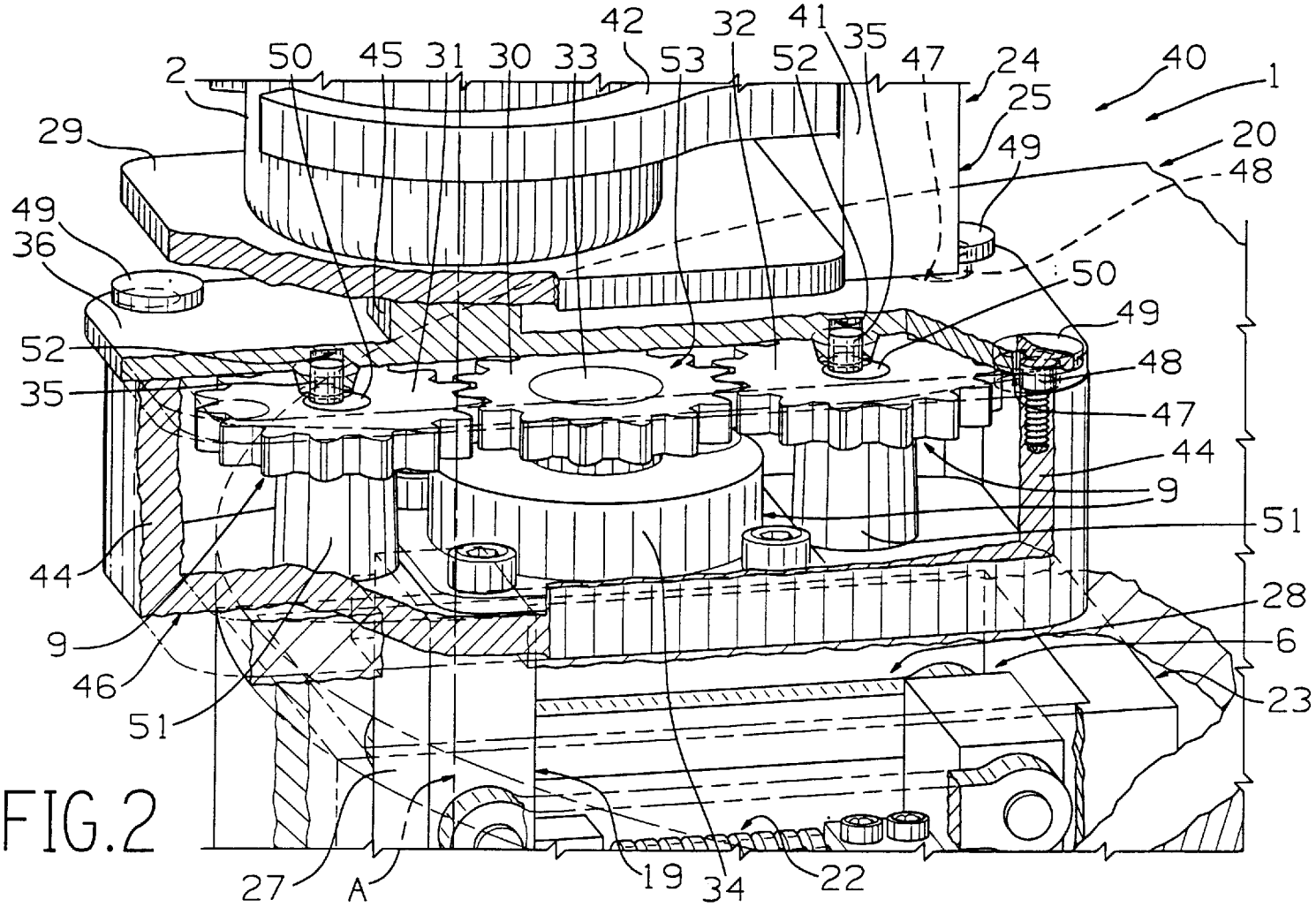
FIG. 2 is a partial perspective view of a second embodiment of the filling unit according to the present invention, with some parts sectioned and removed so as to better evidence others.

With reference to FIGS. 1 and 2, the filling unit 1 is part of a filling equipment, a portion 40 thereof being shown which comprises a carousel 20, only partially shown, equipped with a base 43 and with a horizontal disk 21 which is controlled in such a way as to revolve about a vertical rotation axis 3. The carousel 20 bears a plurality of filling units 1 which are circumferentially located along the filling equipment and supported by the disk 21. While rotating, the carousel 20 moves the filling units 1 forward along a circular filling path.

Each filling unit 1 comprises a measuring device 4, of a known type and which is partially and schematically shown having a duct 5, which is arranged to introduce, by gravity, a predetermined quantity of powder into the corresponding container 2. The measuring device 4 is equipped with means, of a known type and not shown in the appended drawings, destined to control the dispensing of powder through the duct 5. The control means can be composed, for example, of an on-off valve of the duct 5.

Each container 2 is located on a corresponding support equipment 24 which is sustained by a weighing unit 6 which operates along a weighing axis, denoted by the letter A.

The support equipment 24 comprises a bearing device 25 destined to receive a corresponding container 2 on a corresponding horizontal support base 29, which is provided with an upright 41, from which project outwards side holding arms 42 of the container 2 in a predetermined position on the corresponding base 29.

The weighing unit 6 comprises a box-type body 23, mounted on the carousel 20 and enclosing a load cell 22. The load cell 20 has a free end 25 which is in contact with the lower portion of a bracket 26, that is rigidly connected to a tubular body 27 from which the bracket 26 projects towards the load cell 22 (FIG. 1). The tubular body 27 acts as a mobile connecting rod 19 of an articulated quadrilateral 29 that is rigidly and kinematically supported by the box-type body 23.

The weighing unit 6 is arranged to continuously measure the powder that is being introduced into the container 2 during the filling of the container. The unit is operatively connected, in a known and not shown way, to the measuring device 4, so as to stop the dispensing as soon as the quantity of powder introduced into the container 2 has reached a predetermined weight and the container 2 is full. According to the present invention, each filling unit 1 comprises shaking means 9, which are located between the support equipment 24 of the container 2 and the weighing unit 6. In other words, the support equipment 24 is rigidly connected to the weighing unit 6 by interpositioning of shaking means 9.

According to a first preferred embodiment, the shaking means 9 are meant to shake the container 2 by moving it along a trajectory lying on a plane which is substantially perpendicular to the weighing axis A.

In the embodiments illustrated in FIGS. 1 and 2, the shaking plane is substantially horizontal. According to the embodiment illustrated in FIG. 1, the shaking means 9 comprise a first box-type element 7 which is rigidly connected to the connecting rod 19 of the articulated quadrilateral 28 in such a way that the first box-type element 7 rests directly, and along the weighing axis A, on the load cell 22 by means of the bracket 26 that is in contact with the free end 25 of the load cell 22 itself. In order to enable the rigid connection between the first box-type element 7 and the connecting rod 19, the latter projects from the box-type body 23 through an opening 37 which is provided on the upper part of the box-type body 23 of the weighing unit 6. Sealing means, not shown, can be provided in order to act on the opening 37.

The first box-type element 7 has in an inner part a block 38 which is integral with it, from which bilaterally project guides 15 which are horizontal, cylindrical and rectilinear and longitudinally located along the first box-type element 7.

The shaking means 9 also comprise a second slide element E composed of a horizontal upper plate 8*a* and two side vertical walls 8*b* which originate from the plate 8*a*, extending downwards, bilaterally with respect to the block 38. The side walls 8*b* are slidingly connected on the guides 15, and the upper plate 8*a* is provided with a vertical upright 18 which projects from the first box-type element 7 through an opening 17, thus engaging onto the support base 29 of the bearing device 25. In this way, the second slide element 8 is rigidly fixed to the support equipment 24 of the container 2 and is capable of sliding with respect to the first box-type element 7 along the horizontal guides 15.

The support equipment 24 is thus integral with the weighing unit 6 so as to shift in a vertical direction along the weighing axis A and is thus capable of moving, under control, to and fro in a corresponding shaking direction, in this case, along a direction lying on a plane substantially horizontal and perpendicular to the weighing axis A.

It is clear that the opening 17 must have dimensions which are larger than the diameter dimension of the upright 18 in such a way that the latter can move freely inside the opening 17. For this purpose, it is therefore useful to provide sealing means, of a known type and not shown, located on the opening 17 in such a way as to prevent the filtering of powder into the first box-type element 7.

In the embodiment illustrated in FIG. 1, the shaking means 9 also comprise vibrating means 10 meant to transmit to the second element 8 the aforementioned vibrating to-and-fro motion in the horizontal shaking direction, along the guides 15.

The vibrating means 10 are composed of, in this case, an electromagnetic vibrator 11 mounted on an internal side of the first box-type element 7 and interacting with an anchor 12 placed on one of the two side walls 8*b* of the second guide element 8.

In order to enable the correct motion of the second slide element 8, between each of the two side walls 8*b* and the block 38 are provided corresponding springs 14, which are coaxial with respect to each other and parallel to the guides 15, which act in an opposed way. The springs 14, which, in practice, act once as a counteracting mean with respect to the motion of the second element 8 and once as a return mean, make the second element 8 resume, each time, the position assumed before the shift which is due to the action of the electromagnetic vibrator 11. In fact, the springs 14 co-operate with the electromagnetic vibrator 11.

According to a second embodiment illustrated in FIG. 2, the shaking means 9 are composed of a kinematic chain 53 placed horizontally and parallel to the plate 51 of the carousel 20 and contained inside a box-type support 46.

The kinematic chain 53 comprises a driving pinion 30 which engages with two driven gear wheels 31 and 32, which are substantially located on the same horizontal plane and from opposed bands with respect to the pinion 30. The pinion 30 is splined at the end of a vertical shaft 33 of a motor 34 which makes the kinematic chain 53 rotate, and each gear wheel 31, 32 is splined on a corresponding shaft 50 which rotates with it. Each shaft 50 is supported by a corresponding supporting column 51 fixed on the base of the box-type support 46 and is provided on its free end with a corresponding vertical pivot 35, whose axis is eccentrically located with respect to the rotation axis of the shaft 50. The pivots 35 are contained inside corresponding housings 52 obtained on the lower face of a plate 36 which acts as a cover for the box-type support 46, the plate 36 sustaining, by means of an upright 45, the base 29 of the bearing device 25 on which rests the container 2.

The whole unit comprising the plate 36, the pinion 30, the wheels 31,32 and the box-type support 46 is supported by the box-type body 27, which acts also in this case as a connecting rod 19 of the articulated quadrilateral 28. In particular, the plate 36, which is substantially quadrangular in shape, rests with its lower face on the top of the walls 44 of the box-type support 46 and it can freely slide on the walls 44. The plate 36 has, substantially at its top ends, corresponding holes 47 which are crossed by a pivot 48 screwed on the walls of the box-type support 46. The holes 47 show a diametral dimension larger than that of the corresponding pivot 48, and each pivot 48 is covered with a head 49, having a larger diameter dimension than that of the corresponding hole 47, which, together with the walls of the box-type support 46, determines a sliding housing for the plate 36.

In actual practice, the motor 34, by means of its shaft 33, makes the pinion 30 rotate, which makes the wheels 31 and 32 and therefore the corresponding shafts 50 rotate in turn, which shafts, by means of eccentric pivots 35 capable of rotating freely inside each housing 52, make the plate 36, and therefore the support equipment 24 and the container 2, move orbitally.

Also in this second embodiment, illustrated in FIG. 2, the support equipment 24 is integral with the weighing unit 6 for motions in a vertical direction along the weighing axis A and it is capable of carrying out, under a control, the aforementioned orbital motion according to a shaking direction which, in this case, is carried out along a closed trajectory, substantially circular or elliptical, which lies on a plane substantially horizontal and perpendicular to the weighing axis A; as a consequence of this, the powder in the container 2 is tamped, settled and levelled.

In actual practice, the means 9, while the measuring device 4 introduces the powder into the container 2, continuously or alternatively provide for the support equipment 24 to carry out a vibrating motion, which can be either alternate or orbital, circular or elliptical, in the ways and according to the mechanical solutions described above. The formation of a cone of powder is thus prevented during the filling phase, which could overflow from the inlet 2*a* of the container 2. Simultaneously, the weighing unit 6 continuously detects the weight of the material introduced into the container 2.

As soon as the quantity of material in the container has reached a predetermined value, the measuring device 4 automatically interrupts the dispensing of the material. It has been noticed that the shaking action on the container 2 does not interfere with the measuring of the weight carried out by the weighing unit 6 since, in both embodiments of the shaking means 9, the setting in motion of the support equipment 24 always comes about according to a plane which is substantially horizontal and thus perpendicular to the weighing axis A. A highly precise measuring of the powder introduced into the container 2 can thus be obtained.

In a third embodiment, not shown, the filling unit comprises shaking means 9 shaped and placed in such a way as to move the container 2 along a trajectory lying on a plane substantially parallel to the weighing axis A.

What is claimed is:

1. A unit for filling containers with powder, comprising:

support equipment for supporting a container which is to be filled with powder;

a measuring device arranged to introduce powder by gravity into the container;

a weighing unit arranged for operating along a weighing axis of said support equipment and a control axis of said measuring device while powder is being introduced into the container during a filling phase;

shaking means shaped and placed to make the container with respect to said weighing axis, while powder is being introduced into the container, the shaking means being arranged to move the container along a trajectory lying on a plane which is substantially perpendicular to said weighing axis;

said shaking means being located between and arranged to operate between said support equipment and said weighing unit;

said shaking means comprising:

a first box element which is rigidly and kinematically connected to said weighing unit;

said first box element having disposed internally thereof and integral therewith a fixed block which is bilaterally equipped with horizontal guides;

a second slide element arranged to slide along said horizontal guides, with respect to said first box element, alternatingly, in a rectilinear direction; said second slide element being rigidly connected with said support equipment;

return counteracting elastic means located and arranged to operate between said block and said second slide element; and vibrating means disposed between said first box element and said second slide element, for transmitting to said second slide element, in cooperation with said elastic means, vibrating motion along said horizontal guides.

2. The unit of claim 1, wherein:

said vibrating means comprise an electromagnetic vibrator anchored directly to said second slide element.

3. A unit for filling containers with powder, comprising:

support equipment for supporting a container which is to be filled with powder;

a measuring device arranged to introduce powder by gravity into the container;

a weighing unit arranged for operating along a weighing axis of said support equipment and a control axis of said measuring device while powder is being introduced into the container during a filling phase;

shaking means shaped and placed to make the container with respect to said weighing axis, while powder is being introduced into the container, the shaking means being arranged to move the container along a trajectory lying on a plane which is substantially perpendicular to said weighing axis;

said shaking means being arranged to move the container in an orbital motion along a substantially circular or elliptical closed trajectory;

said shaking means comprising:

a support box rigidly and kinematically connected to said weighing unit;

a kinematic chain driven by a motor and supported inside said support box; said kinematic chain being kinematically connected, eccentrically, to said support equipment for causing said support equipment to carry out under control of said motor, said orbital motion.

4. The unit of claim 3, wherein:

said kinematic chain comprises a driving pinion engaging with two driven gear wheels which are placed from opposed bands of said driving pinion;

said motion having a shaft having a rotation axis;

said driving pinion being splined at end of said shaft;

each of said gear wheels being splined on a respective shaft equipped on a free end thereof with a respective pivot having a respective axis which is eccentric with respect to said rotation axis;

a plate arranged to move freely with respect to said support box and sustaining said support equipment; and said pivots being kinematically connected to said plate.

* * * * *